United States Patent [19]

Casey

[11] 3,963,513

[45] June 15, 1976

[54] PROCESS AND APPARATUS FOR TREATMENT OF CANE SUGAR JUICE

[76] Inventor: John A. Casey, 1755 Beach St., San Francisco, Calif. 94123

[22] Filed: Oct. 21, 1974

[21] Appl. No.: 516,341

[52] U.S. Cl. ..... 127/11; 23/283; 127/14; 127/48; 210/205; 210/57; 210/54; 259/4 R

[51] Int. Cl.[2] ..... C13D 3/02; B01F 5/00

[58] Field of Search ..... 127/11-14, 127/48, 50; 261/79 A, 112, DIG. 76; 23/283, 284, 285; 259/4 R, 18, 36; 210/205, 206, 213, 207; 137/604

[56] References Cited

UNITED STATES PATENTS

| | | | |
|---|---|---|---|
| 1,903,215 | 3/1933 | Graham | 127/48 |
| 2,082,656 | 6/1937 | Reichert et al. | 127/48 X |
| 2,520,957 | 9/1950 | Peterson | 127/11 |

*Primary Examiner*—Morris O. Wolk
*Assistant Examiner*—Roger F. Phillips
*Attorney, Agent, or Firm*—Townsend and Townsend

[57] ABSTRACT

Method and apparatus for controlled growth of precipitates in systems requiring separation of undesirable contaminants from a solution prior to treatment with a coagulant aid. Cane sugar juice, as exemplary, is introduced at an elevated temperature into an apparatus having means for maintaining a mildly reduced pressure. The apparatus has a conical funnel with a downwardly extending tubular outlet. Means are provided for incrementally and continuously introducing a chemical treating agent into the juice, as it flows down the funnel toward the outlet. Juice discharge means allows for control of the retention time in the tower. The method of treating cane sugar juice is as follows. Cane sugar juice, preferably partially limed, is introduced into the top of the funnel at an elevated temperature and allowed to flow by gravity flow through the funnel, while additional milk of lime is incrementally and continuously introduced into the cane sugar. The cane sugar juice flows downwardly through an outlet and then upwardly to allow for controlled formation of insoluble precipitate particles.

8 Claims, 2 Drawing Figures

PROCESS AND APPARATUS FOR TREATMENT OF CANE SUGAR JUICE

BACKGROUND OF THE INVENTION

Field of the Invention

Juice from cane sugar has been conventionally clarified by the application of lime and heat followed by extended settling in large tanks. More recently, chemical polyacrylamides have been used to accelerate the coagulation and settling of these cane sugar juices, both in conventional large clarifying tanks and in smaller specially designed tanks to take advantage of the accelerated coagulation provided by the polyacrylamide.

The nature of cane sugar juice is that the insoluble solids, which are precipitated by the conventional addition of lime and application of heat, are gummy and sticky. In addition, the natural variation in cane juice quality is such that the physical characteristics of the precipitate are variable. This variation makes it difficult to provide equipment, which will allow the clarification of cane sugar juice in the fastest manner when treated with polyacrylamide.

In normal processing, cane sugar juice is limed and heated with the pH of the juice increasing from a range of 5.0–6.5 to about 6.8–7.5. After liming, a dilute solution of polyacrylamide is then added to the juice to enhance coagulation. Various rapid clarifying apparatuses may be employed such as the "EIS Rapid Clarifier," U.S. Pat. No. 2,679,464; I.S.J. 1955, 57, 25, or the "SRI Clarifier," developed by the Sugar Research Institute of Australia.

SUMMARY OF THE INVENTION

Apparatus and method are provided for treating and deaerating a liquid containing undesirable precipitable contaminants, e.g. cane sugar juice. In a cylindrical tower is mounted a conical funnel having an outlet conduit extending downwardly and opening adjacent the bottom of the tower. A perforated spiral tube is circumferentially nested in the conical funnel. Means are provided for connecting to a vacuum source and varying the residence time of the liquid in the tower before transfer.

In purifying cane sugar juice, the juice is first treated with a salt mixture, optionally followed by liming to a pH of about 6.5, and heated to above the boiling point of water, usually not exceeding about 230°F. The hot cane sugar juice stream is then slowly moved, as a relatively thin film through a liming zone, where lime is continuously and incrementally introduced into the juice, while vapor is removed overhead. The pH of the cane sugar juice is increased to not greater than about 7.5. From the liming zone, the juice flows in a substantially nonturbulent manner through a precipitate forming zone, while maintaining a reduced pressure with concommitant loss of water and temperature drop. In the precipitate forming zone, the juice stream moves downwardly under gravity flow and then upwardly at a slower rate with the residence time varying with the particular cane juice. The juice is then transferred to a clarifier for further treatment including treatment with polyacrylamide.

DESCRIPTION OF THE SPECIFIC EMBODIMENTS

Figure 1:
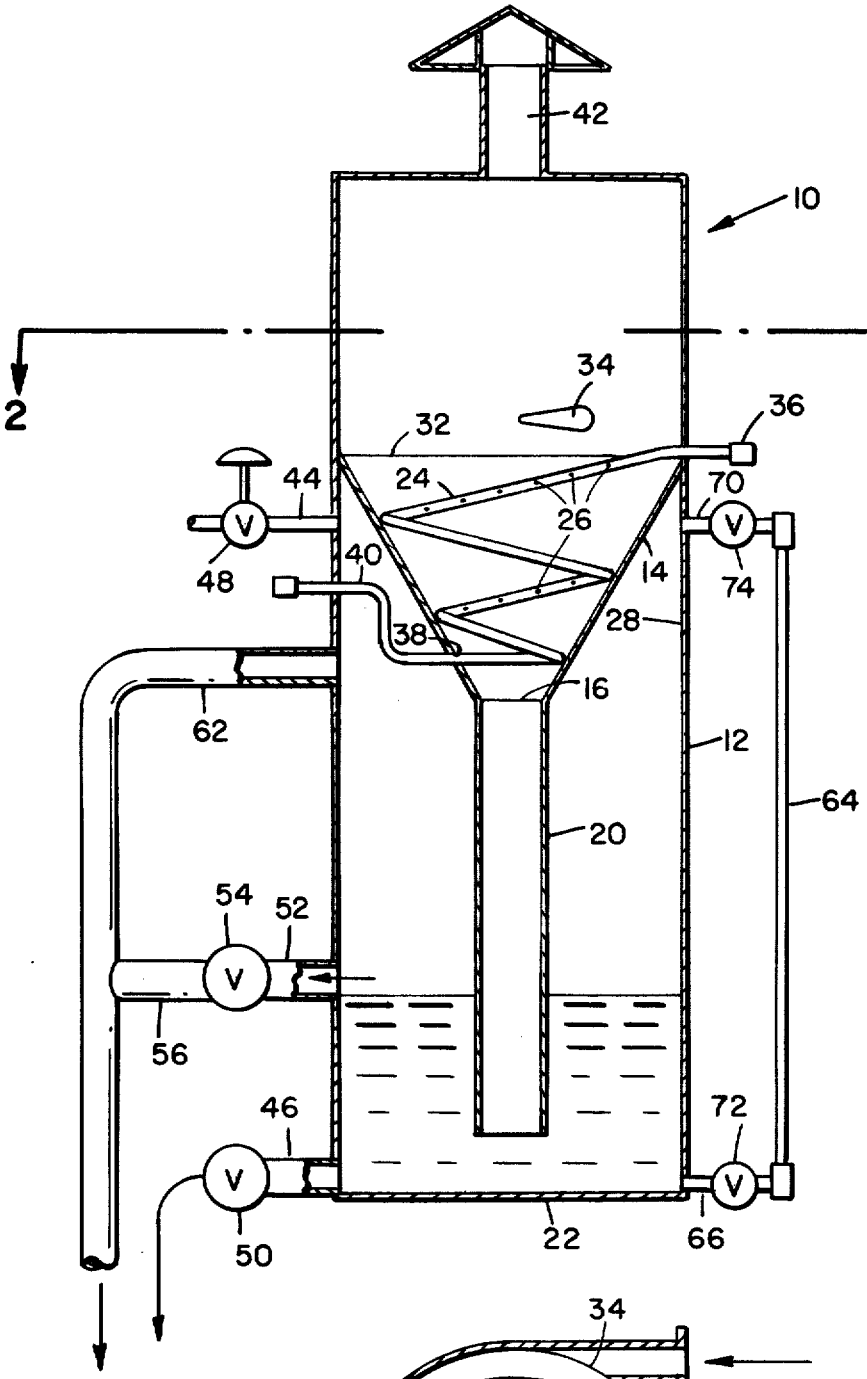
FIG. 1 is an elevational cross section of the chemical treatment and deaeration tower of this invention.

A method and apparatus are provided for the chemical treatment and deaeration of a viscous solution having undesirable precipitable contaminants, as is found, for example, with cane sugar juice. The apparatus is conveniently a cylindrical tower with an overhead vent having a conical funnel fitted into an upper portion of the tower to form a tight seal with an outlet conduit extending a substantial portion of the height of the tower and opening adjacent the bottom of the tower. A perforated spiral tube of an inert material, e.g. plastic, is circumferentially nested in the conical funnel extending from an upper portion of the conical funnel to a lower portion adjacent the outlet connected to the outlet conduit.

Connecting means are provided for connecting the spiral tube to a source of a chemical treatment solution at the upper end of the spiral and to an outlet conduit for any excess solution to be discarded or recycled. Means are provided in an upper portion of the tower beneath the rim of the funnel for connecting to a vacuum source and regulating the internal pressure of the tower beneath the funnel. Solution inlet means is provided adjacent an upper portion of the conical funnel, so that the solution is introduced in a substantially horizontal direction and follows a relatively spiral path about the cone. Means are provided for withdrawing the solution at varying heights from a lower portion of the tower, so as to be capable of varying the residence time of the solution in the tower.

In employing the subject apparatus with cane sugar juice, the cane sugar juice may be first treated with a small amount of a salt mixture. The salt mixture will normally include sodium aluminate, aluminum sulphate, trisodium phosphate and sodium tri-polyphosphates, generally added to the juice in total amount of not more than about 250 ppm. The exact composition and amount employed will depend upon the particular quality of the juice being treated at the time, the salts aiding in the controlled growth of hydroxides and calcium phosphates during the liming of the hot cane sugar juice.

Lime is optionally added prior to introduction into the deaeration tower to provide a pH of about 6.5. The can sugar juice as initially provided will generally have a pH in the range of about 5.0–6.5 and may be treated with milk of lime (1–15 weight percent) to bring the pH to about 6.5. After mixing the cane sugar juice with the salt mixture and optionally lime, the juice is heated to a temperature above the boiling point of water (212°F) and below about 230°F, normally about 220°F. The cane sugar juice stream then flows through an extended path, while dissolved gases and water vapor flash off.

The extended path is achieved in the subject apparatus by introducing the cane sugar juice stream under pressure tangentially to the conical funnel, so that the initial flow is horizontal. The cane sugar juice then swirls about the cone in a spiral path substantially as a thin film. Milk of lime is continuously and incrementally introduced into the cane sugar juice stream by a spiral perforated feed pipe nested in the conical funnel. The pH of the cane sugar juice is raised to a pH in the range of about 6.8–7.5, as required by the particular juice undergoing treatment to achieve the desired settling characteristics of the precipitate and the clarity of the juice. The amount of lime necessary to achieve the pH is controlled by continually sampling the juice being discharged from the tower.

After exiting from the funnel, which serves as a liming and deaerating zone, the cane sugar juice stream flows by gravity flow to a holding and discharge zone, which also serves to further deaerate the juice. Removal of water vapor and gases is enhanced by applying a mild vacuum in the holding zone, usually not exceeding about 10 inches mercury. The stand pipe extends almost to the bottom of the tube, so that the liquid must flow downwardly and then upwardly. The stream cross section in the holding zone is greatly expanded reducing the flow rate. The holding zone serves as a precipitate forming zone, and by controlling the distance which the cane sugar stream must flow, the residence time of the cane sugar juice in the precipitate forming zone is also controlled. The time in the tower is generally in the range of 3 to 10 minutes. The major proportion of the residence time in the tower will be in the holding zone.

The cane sugar juice is then discharged to a clarifier for further treatment including the addition of dilute solutions of polyacrylamide. The solution of polyacrylamide is normally diluted in water to concentrations of about 0.01 to 0.1 weight percent and is added in amounts based on polyacrylamide of about 0.25 to 5.0 ppm based on cane sugar juice weight.

The rate and manner of flow of the cane sugar juice stream through the stand pipe and particularly in the holding zone area is such as to avoid any significant turbulence, which would break up the growing particles and/or reduce their density. At the same time, the rate and manner of movement of the juice must be such as to avoid settling of the insoluble particles from the juice within the holding zone.

The deaeration of the juice which is achieved is of great significance during the further processing. Air bubbles forming in the subsequent clarification is a detriment to clarifier performance. The air bubbles combine with particles of insoluble solids causing them to rise through the clarifier and overflow with the clear juice, instead of the particles settling rapidly to the bottom of the tower.

For further understanding of the subject invention, the drawings will now be considered.

In FIG. 1, the degasifier 10 has a cylindrical tower 12. The tower should be well insulated to reduce heat losses. Fitted in the tower is a conical funnel 14 whose outlet 16 is connected to stand pipe 20, which extends vertically downwardly, opening adjacent the bottom 22 of tower 12. Nesting in funnel 14 is spiral tube 24 having a plurality of perforations 26 along its length. The tube 24 is conveniently an inert plastic tube, which is circumferentially clamped to the inner wall 30 of conical funnel 14. The circumferential tube serves as a feed tube for the continuous and incremental addition of a chemical treating solution. In this manner, thorough and uniform mixing is achieved without high localized concentrations occurring. The rim 32 of the funnel forms a tight seal with the inner wall 28 of the tower 12.

Adjacent the rim 32 of the conical funnel 14 is a tangential inlet 34, which feeds the feedstock solution horizontally into the conical funnel 14. The path of the feedstock through the funnel is therefore substantially a spiral path, so that a relatively thin stream has an extended path and extended residence time in the funnel. The spiral nature of the path is further augmented by the spiral shape of the chemical treating solution feed tube 24. The feed tube 24 is connected to inlet conduit 36, and outlet conduit 40, both of which extend through the wall of tower 12 and are sealed to the wall to prevent air leakage. Outlet conduit 40 extends through opening 38 in the conical funnel to connect with feed tube 24. The outlet conduit 40 is bent upwardly in an S-shape, so as to provide a hydrostatic pressure head to encourage the flow of the chemical treatment solution out of the perforations 26.

A vent 42 is provided through which vapors may exit. A vacuum outlet 44 is provided below the conical funnel rim 32 for reducing the pressure in the lower portion of the tower with vacuum regulating gauge 48 provided, for controlling the level of the vacuum in the tower. Adjacent to tower bottom 22 is drain conduit 46 fitted with valve 50. The drain conduit 46 provides for ease of cleaning of the tower.

At an intermediate distance from the tower bottom 22 is lower discharge outlet 52 fitted with valve 54, which is connected by means of conduit 56 to tower outlet pipe 60. Above discharge outlet 52 is the upper discharge outlet 62, which provides for the maximum height level of the treated solution in the tower 12. Discharge outlet 62 empties into outlet pipe 60.

In order to monitor the solution level in the tower, level gauge 64 is provided, which communicates with the tower through conduits 66 and 70 at its lower and upper ends respectively. Valves 72 and 74 control communication between the tower and gauge 64.

Figure 2:
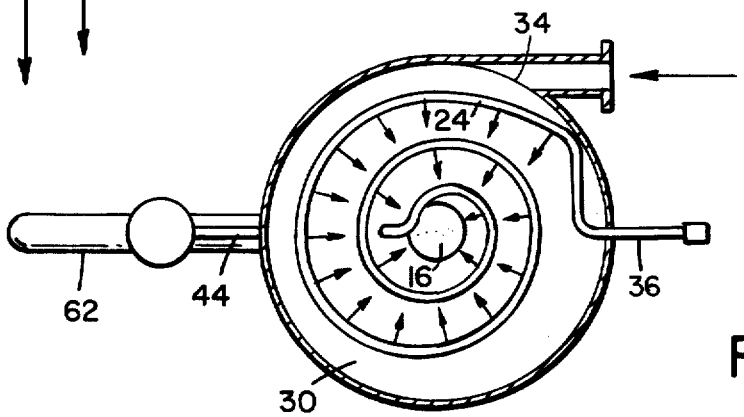
FIG. 2 is a plan view along lines 2—2 of FIG. 1.

In FIG. 2 is seen the feedstock inlet conduit 34, which feeds the feedstock with sufficient centrifugal force so that a spiral path occurs along wall 30. The spiral tube 24 feeds the chemical treating solution continuously as the feedstock moves downwardly toward outlet 16. In this manner localized high concentrations of the chemical treating solution are avoided, and a continually increasing concentration of the chemical treating solution is introduced into the feedstock. This allows for uniform distribution of the chemical treating solution into the feedstock. The spiral path of the feedstock enhances the residence time for deaeration and treatment and allows for a slow controlled buildup of the chemical treating agent in the solution being treated.

In a particular apparatus, a tower, 9 feet high and 36 inches in diameter, was employed with the rim of the cone 2½ feet below the tower top. The funnel was 2½ feet long and had a 6 inch outlet with the stand pipe extending to within about 1 foot of the bottom of the tower. The discharge conduits were set at about 2 feet and about 4½ feet from the bottom of the tower.

The chemical treating tube was plastic of about ¾ inch O. D., which was clamped to the inner wall of the cone. By employing a device of these dimensions, and with a residence time in the range of 3 to 10 minutes, good particle formation was achieved with efficient clarification during the subsequent clarification treatment. Excellent control of the pH was maintained.

While the subject invention and method finds particular use with rapid clarifiers, the apparatus can be used with other conventional clarifiers including those provided by Dorr Oliver, Bach Clarifiers, etc. The subject apparatus and method is paritcularly useful for the controlled growth of precipitates prior to treatment with a coagulant aid. With cane sugar juice, slow controlled buildup of precipitates with concommitant deaeration is achieved. The removal of the dissolved gases prevents the subsequent formation of air bubbles during clarification which entrain precipitate particles when rising to the surface, which result in the precipitate particles overflowing with the clarified cane sugar juice.

Although the foregoing invention has been described in some detail by way of illustration and example for purposes of clarity of understanding, it will be obvious that certain changes and modifications may be practiced within the scope of the appended claims.

What is claimed is:

1. An apparatus for the chemical treatment of a solution to induce controlled growth of undesirable precipitables in said solution which comprises:

a treating tower having vapor outlet means in an upper portion of said tower;

conical funnel means in an upper portion of said tower communicating with a vertical exit conduit extending to a lower portion of said tower;

spiral tubular feeding means, perforated along its length, nesting in said conical funnel and having inlet and outlet conduit means for receiving and discharging a solution;

means for introducing a feedstock solution tangentially to an upper portion of said conical funnel means at a velocity sufficient to cause said feedstock to flow in a substantially spiral path in said conical funnel from the upper portion thereof to said vertical exit conduit; and discharging means in a lower portion of said tower for varying the residence time of said feedstock solution.

2. An apparatus according to claim 1, wherein said conical funnel means has an upper rim integral with the interior wall of said tower to form a seal therebetween so that the pressure below said conical funnel means can be reduced, said apparatus further comprising evacuating means communicating with said tower for reducing the pressure below said conical funnel means.

3. An apparatus according to claim 2, further comprising a plurality of discharge outlets at varying heights as said discharging means.

4. An apparatus according to claim 1, further comprising a plurality of outlets at varying heights as said discharging means.

5. An apparatus according to claim 1, wherein said outlet conduit means extends upwardly to provide a hydrostatic pressure head in said perforated spiral tubular means.

6. A method for treating cane sugar juice for deaeration and enhancing precipitate growth, which comprises:

in a treating zone, treating a thin film of cane sugar juice flowing through an extended path and initially at a temperature above the boiling point of water, incrementally and continuously along said path with milk of lime to raise the pH of said solution to a final pH in the range of about 6.8–7.5, while removing vapors overhead; and in a holding zone, reducing the rate of flow of said cane sugar juice received from said treating zone, while removing vapors by means of reduced pressure and maintaining a substantially nonturbulent flow to provide a total residence time in said treating zone and said holding zone in the range of about 3 to 10 minutes.

7. A method according to claim 6, wherein said cane sugar juice is limed to a pH of about 6.5 prior to introduction into said treating zone.

8. A method according to claim 5, wherein said thin film in said treating zone, flows in a substantially downward spiral path, while said cane sugar juice in said holding zone flows in a substantially upward path.

* * * * *